US009149852B2

(12) United States Patent
Anderson

(10) Patent No.: US 9,149,852 B2
(45) Date of Patent: Oct. 6, 2015

(54) PANEL CRIMPING MACHINE WITH CONTROL SYSTEM FOR CONTROLLING TIMING BETWEEN CRIMPING ROLLERS WITH AN ADJUSTABLE SEPARATION

(71) Applicant: M.I.C. Industries, Inc., Reston, VA (US)

(72) Inventor: Todd E. Anderson, Duncansville, PA (US)

(73) Assignee: M.I.C. Industries, Inc., Reston, VA (US)

( * ) Notice: Subject to any disclaimer, the term of this patent is extended or adjusted under 35 U.S.C. 154(b) by 203 days.

(21) Appl. No.: 13/828,876

(22) Filed: Mar. 14, 2013

(65) Prior Publication Data

US 2014/0260485 A1 Sep. 18, 2014

(51) Int. Cl.

| | |
|---|---|
| ***B21D 13/04*** | (2006.01) |
| ***B21D 5/14*** | (2006.01) |
| ***B30B 1/14*** | (2006.01) |

(52) U.S. Cl.

CPC *B21D 13/04* (2013.01); *B21D 5/14* (2013.01); *B30B 1/14* (2013.01)

(58) Field of Classification Search

CPC .... B21D 13/04; B21D 13/045; B21B 27/021; B21B 35/12; B30B 1/266; B30B 1/14

USPC ..... 72/449, 450

See application file for complete search history.

(56) References Cited

U.S. PATENT DOCUMENTS

| | | | | |
|---|---|---|---|---|
| 2,028,388 | A | | 1/1936 | Gerard et al. |
| 2,370,702 | A | | 3/1945 | Yoder |
| 2,561,634 | A | | 7/1951 | Picton |
| 2,747,641 | A | | 5/1956 | Lapidus |
| 2,750,982 | A | | 6/1956 | Smon et al. |
| 2,901,951 | A | | 9/1959 | Hochfeld |
| 3,670,553 | A | | 6/1972 | Nothum |
| 3,777,531 | A | | 12/1973 | McClain |
| 3,842,647 | A | * | 10/1974 | Knudson ..... 72/177 |
| 3,902,288 | A | | 9/1975 | Knudson |
| 4,050,277 | A | | 9/1977 | Malott et al. |
| 4,140,001 | A | | 2/1979 | Moulton |
| 4,364,253 | A | | 12/1982 | Knudson |
| 4,505,084 | A | * | 3/1985 | Knudson ..... 52/528 |
| 4,505,143 | A | | 3/1985 | Knudson |
| 4,903,516 | A | | 2/1990 | Olsson et al. |
| 5,134,873 | A | | 8/1992 | Miyagawa et al. |

(Continued)

FOREIGN PATENT DOCUMENTS

| | | |
|---|---|---|
| EP | 0009703 | 4/1980 |
| GB | 1204916 | 9/1970 |

*Primary Examiner* — Debra Sullivan

(74) *Attorney, Agent, or Firm* — Jones Day

(57) ABSTRACT

A panel crimping apparatus comprises a frame, a first crimping roller supported by the frame, the first crimping roller comprising a first shaft, a plurality of first crimping blades, and a first drive gear attached to the first shaft, and a second crimping roller supported by the frame, the second crimping roller comprising a second shaft, a plurality of second crimping blades, and a second drive gear attached to the second shaft. A distance between the first and second shafts of the first and second crimping rollers is adjustable. The apparatus comprises various links, gears and a control linkage configured to maintain timing between the first and second crimping rollers during driving of the first and second crimping rollers over an adjustable range of distance therebetween.

7 Claims, 12 Drawing Sheets

(56) References Cited

U.S. PATENT DOCUMENTS

| | | | | |
|---|---|---|---|---|
| 5,249,445 | A | 10/1993 | Morello | |
| 5,857,377 | A | 1/1999 | Sartorio | |
| 6,546,775 | B2 | 4/2003 | Morello | |
| 6,722,087 | B1 | 4/2004 | Morello | |
| 6,820,452 | B2 | 11/2004 | Morello | |
| 6,920,775 | B2 * | 7/2005 | Morello | 72/379.6 |
| 8,033,070 | B2 | 10/2011 | Morello et al. | |
| 2009/0320545 | A1 | 12/2009 | Robins | |
| 2012/0323354 | A1 | 12/2012 | Anderson et al. | |
| 2013/0227896 | A1 | 9/2013 | Anderson et al. | |

* cited by examiner

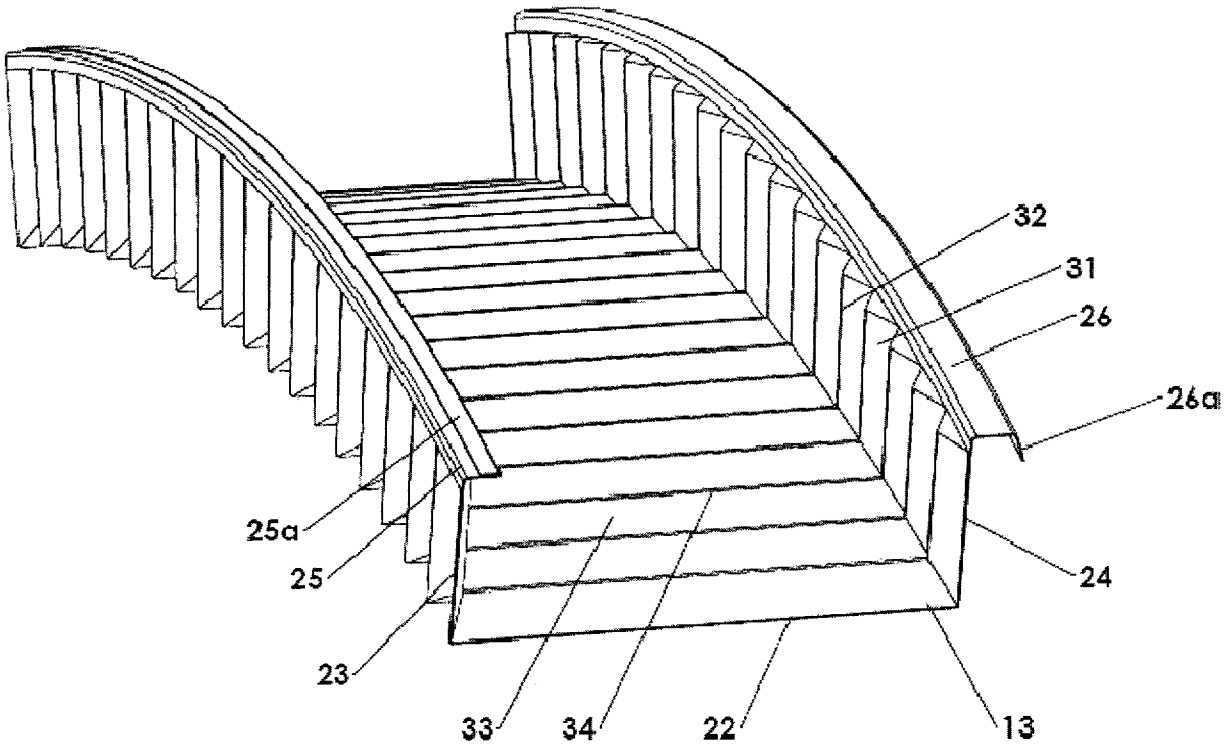
CONVENTIONAL
FIG. 4

PANEL CRIMPING MACHINE WITH CONTROL SYSTEM FOR CONTROLLING TIMING BETWEEN CRIMPING ROLLERS WITH AN ADJUSTABLE SEPARATION

BACKGROUND

1. Field of the Disclosure

The present disclosure relates to crimping systems and methods for forming longitudinally curved building panels of sheet material that can be connected together to form free-standing, self-supporting buildings. More particularly, the present disclosure relates to panel crimping machines and associated methods for crimping (corrugating) such a building panel so as to impart a longitudinal curve to the building panel along its length.

2. Background Information

Methods and machines are known in the art for forming building panels of desired shapes made from sheet material, e.g., galvanized steel sheet metal. Such building panels can be attached side-by-side to form self-supporting building structures by virtue of the strength of the building panels themselves. That is, such interconnected building panels can exhibit a moment of inertia suitable to provide enough strength under applied loads (e.g., snow, wind, etc.) so that supporting beams or columns within the building structure are unnecessary. In other words, the interconnected building panels themselves may form a load-bearing roof portion and a load-bearing wall portions of a self-supporting building without the need for supporting beams, columns, joists and the like. FIGS. 1-3 illustrate exemplary shapes of self-supporting metal buildings. These exemplary building shapes include double-radius (or two-radius) style buildings, an example of which is shown in FIG. 1, gable style buildings, an example of which is shown in FIG. 2, and circular or arch style buildings, an example of which is shown in the example of FIG. 3. In the exemplary buildings illustrated in FIGS. 1-3, building panels that include longitudinally curved building panels are used to form the side and roof sections, and substantially straight building panels or other materials are used to construct the flat end-wall sections.

As is known in the art, building panels of a desired cross-sectional shape may be formed from steel sheet metal using a panel forming apparatus having particular configurations of steel rollers. Flat sheet metal is introduced into the panel forming apparatus, and the rollers contact and deform the sheet metal as it passes through the panel forming apparatus, such that the building panel emerges with a desired cross sectional shape.

The resulting building panel, having been shaped in cross section, can then be curved (arched) in the longitudinal direction (perpendicular to the transverse, cross-sectional direction) using a panel curving apparatus. One type of curving apparatus utilizes rollers having crimping blades that indent the building panel to impart transverse corrugations (or cross corrugations) of suitable depths into the panel as the building panel passes through the apparatus, so as to provide the longitudinal curve to the building panel. Exemplary crimping machines of this type are disclosed in U.S. Pat. Nos. 3,902,288, 4,364,253, 4,505,143, 5,249,445, 6,820,452 and 6,722,087, and 8,033,070, the entire contents of each of which are incorporated herein by reference.

An exemplary conventional building panel having such transverse corrugations is shown in FIG. 4 as described in U.S. Pat. No. 3,902,288. The building panel illustrated in FIG. 2 is generally box-shaped and has a base or bottom portion 22, a pair of spaced upright side portions 23 and 24 projecting upwardly from the opposite marginal edges of and in a direction transverse to the flat bottom portion 22, and an upper in-turned flange portion 25 projecting inwardly from the upper marginal edge of and in a direction transverse to the side portion 23. An upper out-turned flange portion 26 projects outwardly from an upper marginal edge of and in a direction transverse to the side portion 24 and has a down-turned terminal portion 26*a* at the outer marginal edge thereof. The in-turned flange portion 25, has a terminal section 25*a* bent toward the side portion 23 to provide a reverse bend or fold and a double thickness. The out-turned flange portion 26 is bent downwardly to provide generally U-shaped connecting channel with a bottom opening. The bottom opening formed by the out-turned flange portion 26 is of greater width than the in-turned flange portion 25 so that it will receive the in-turned flange portion of the next adjacent panel directly through the bottom opening in order to connect adjacent panels together.

Such panels can be curved in the longitudinal direction by forming transverse corrugations in the center portion 22 and in the side portions 23 and 24, the corrugations being comprised of a series of alternative grooves and ridges. Grooves and ridges forming transverse corrugations in the side portions 23 and 24 are designated by numerals 31 and 32, respectively. Grooves and ridges forming transverse corrugations in the center portion are designated by numerals 33 and 34, respectively.

The transverse corrugations can be formed in both the center portion and side portions of the building panel using a panel crimping machine with pairs of crimping rollers that have opposing crimping blades to impart the transverse corrugations.

The present inventor has observed a need for an improved drive system for a panel crimping machine that can better maintain proper timing between a pair of crimping rollers if the separation distance between the crimping rollers is changed, and the exemplary systems and approaches described herein may address that need.

SUMMARY

The present inventor has developed a novel panel crimping machine with an improved drive system for driving a pair of crimping rollers, each roller having multiple crimping blades, such that proper timing between the pair of crimping rollers can be effectively maintained, even as the separation distance between the crimping rollers is changed. Changing the separation between the crimping rollers can permit forming transverse corrugations of different depths in a building panel so as to change the degree of longitudinal curving of the building panel since the depth of the transverse corrugations may be related to the degree of longitudinal curving. Relatively deeper corrugations may permit curving building panels longitudinally to a greater extent, i.e., to form building panels with relatively smaller radii of curvature longitudinally. The present inventor has observed that maintaining proper timing between the pair of crimping rollers can be desirable to improve control over the rotational positions of the crimping blades of the crimping rollers, and thereby improve control over the process of longitudinally curving the building panel.

According to an exemplary aspect, a panel crimping apparatus comprises a frame, a first crimping roller supported by the frame, the first crimping roller comprising a first shaft, a plurality of first crimping blades, and a first gear attached to the first shaft, and a second crimping roller supported by the frame, the second crimping roller comprising a second shaft, a plurality of second crimping blades, and a second gear attached to the second shaft. A distance between the first and second shafts of the first and second crimping rollers is adjustable. The apparatus also comprises a third gear and a fourth gear, the third and fourth gears configured to mesh with each other, the third gear configured to mesh with the first gear, and the fourth gear configured to mesh with the second gear. The system also comprises a first link rotatably connecting the first shaft and a shaft of the third gear, a second link rotatably connecting the second shaft and a shaft of the fourth gear, and a third link rotatably connecting shafts of the third and fourth gears. The system also comprises a control linkage configured to maintain timing between the first and second crimping rollers during driving of the first and second crimping rollers over an adjustable range of distance therebetween.

BRIEF DESCRIPTION OF THE DRAWINGS

These and other features, aspects, and advantages of the present disclosure will become better understood with regard to the following description, appended claims, and accompanying drawings.

FIG. 4 illustrates an exemplary building panel known in the art having transverse corrugations.

DETAILED DESCRIPTION OF EXEMPLARY EMBODIMENTS

Exemplary embodiments of a system and method for providing drive and timing between crimping rollers in a building panel crimping machine are described. The longitudinal radius of curvature of a building panel passed through a panel crimping machine as explained herein may be controlled by the depth of the crimps (transverse corrugations) formed in the panel by the panel crimping (corrugating) machine. The center distance (separation distance) between crimping rollers, which comprises crimping blades for imparting the transverse corrugations, can be varied in order to adjust the crimp depth (corrugation depth) to produce a desired longitudinal radius of curvature in the building panel. The crimping roll drive system should be able to provide rotational drive as the separation distance between the crimping rollers is varied as well as maintain timing between the crimping rollers so individual blades on the crimping rollers do not collide with one another.

Figure 1:
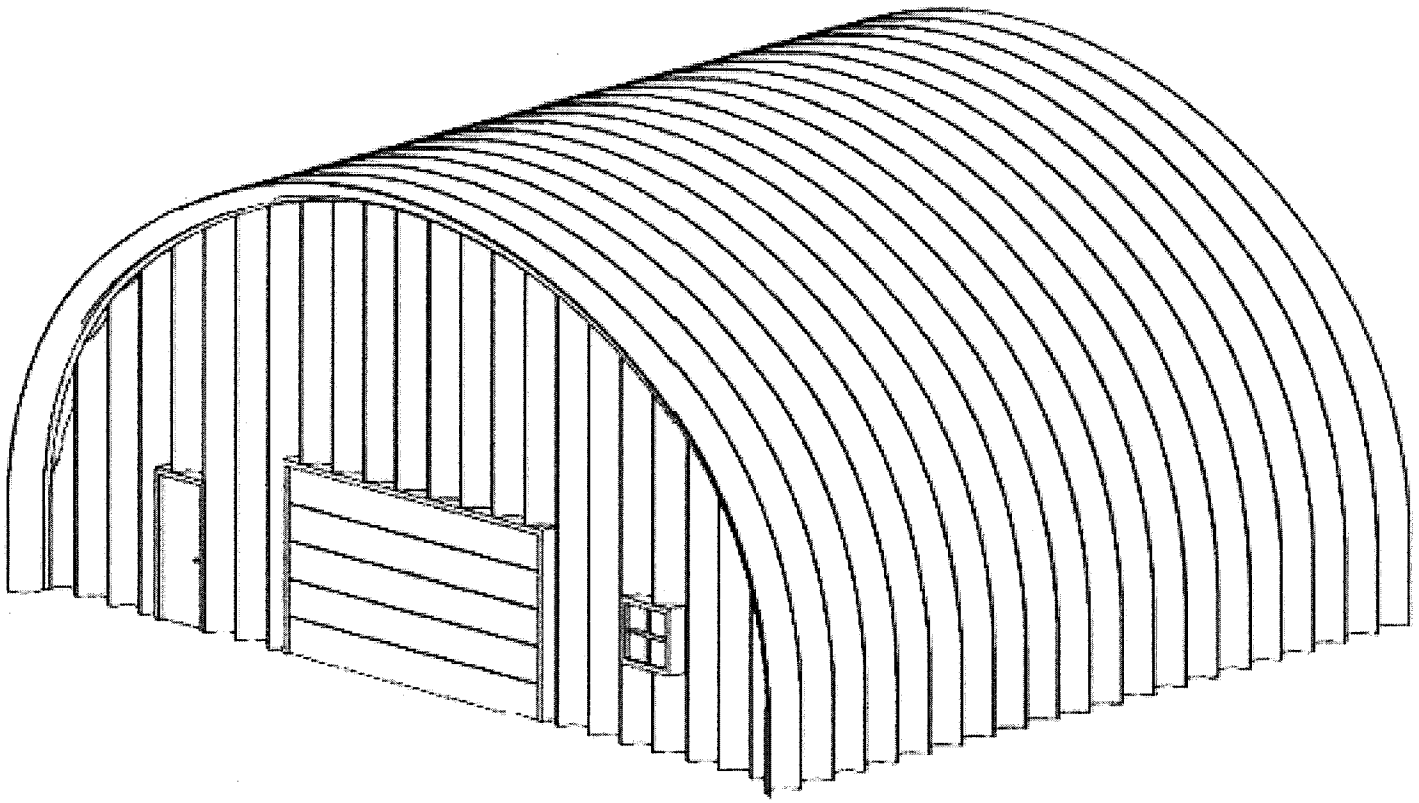
FIG. 1 (Prior Art)
FIG. 1 illustrates an exemplary double-radius (or two-radius) style building that can be formed using building panels formed from sheet material.
Figure 2:
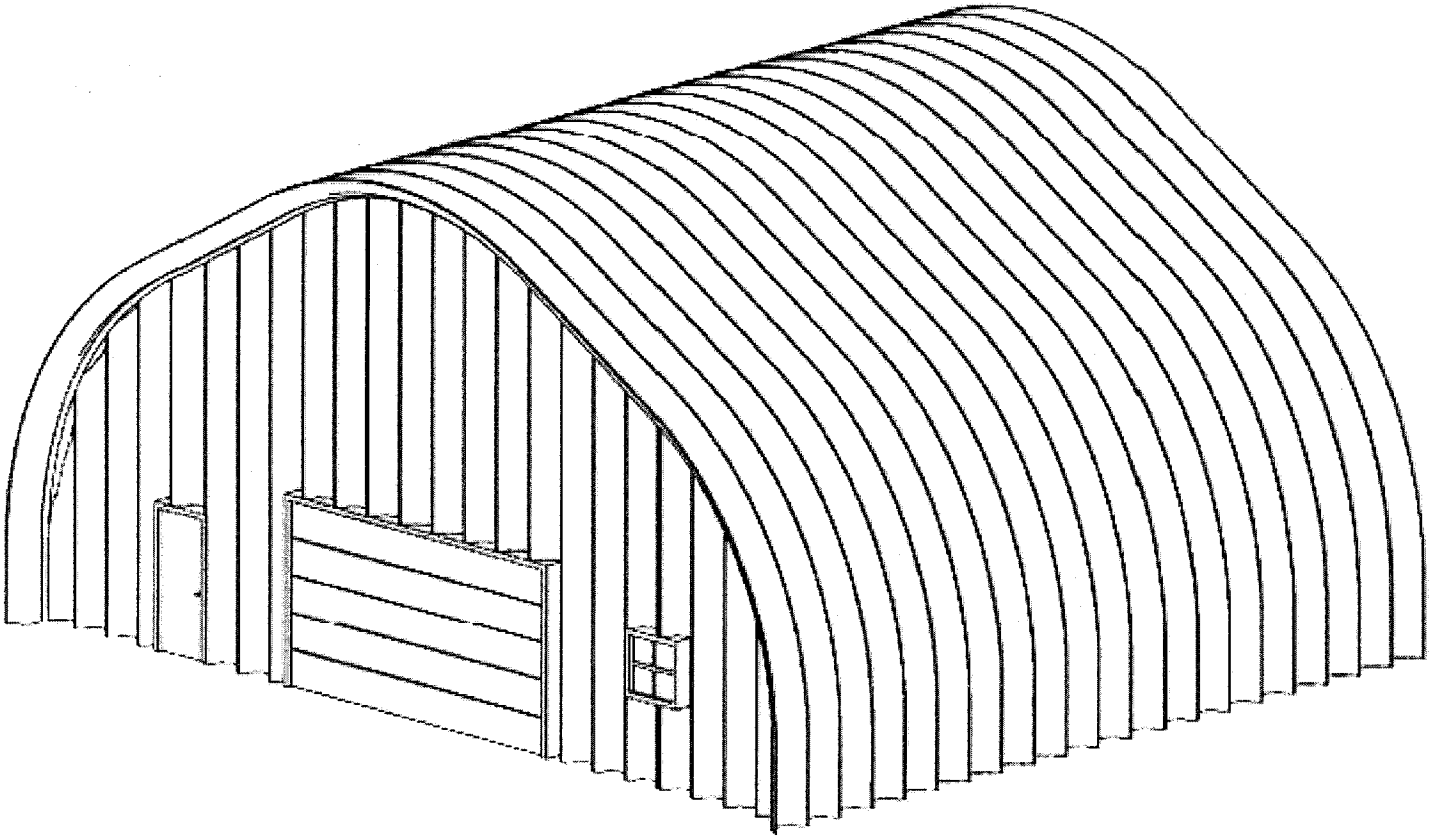
FIG. 2 (Prior Art)
FIG. 2 illustrates an exemplary gable style building that can be formed using building panels formed from sheet material.
Figure 3:
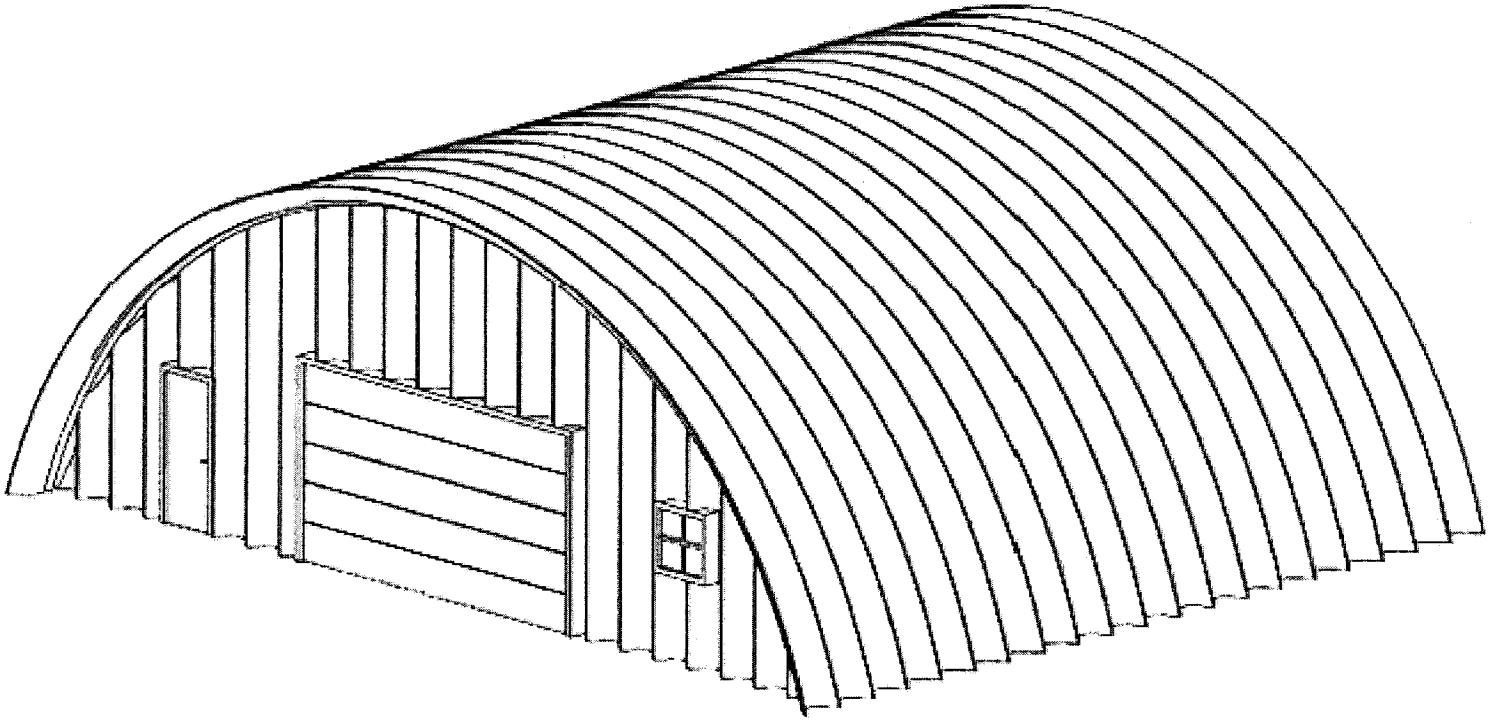
FIG. 3 (Prior Art)
FIG. 3 illustrates an exemplary circular or arch style building that can be formed using building panels formed from sheet material.
Figure 5:
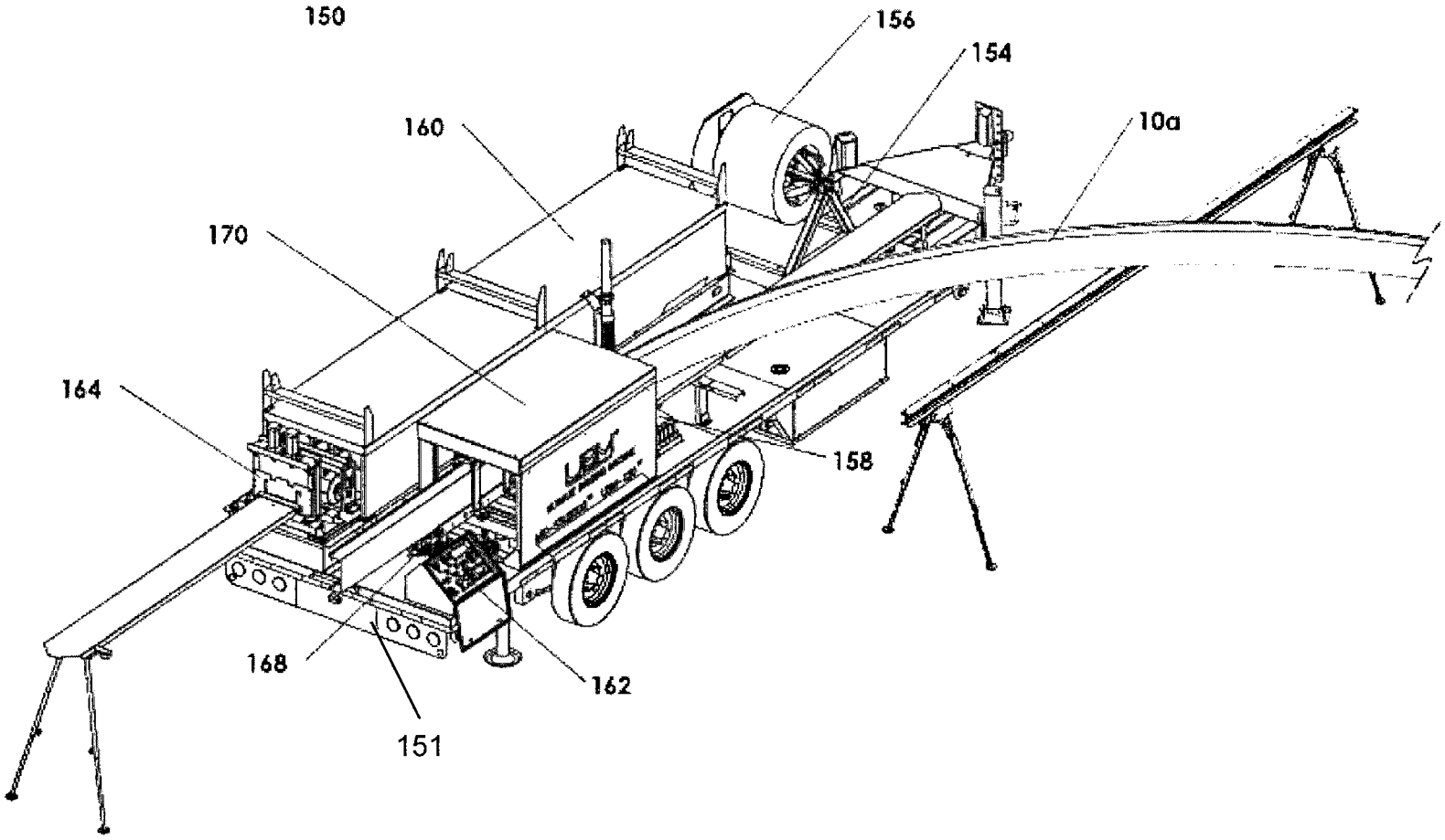
FIG. 5 illustrates an exemplary system for forming and curving a building panel made of sheet material.

FIG. 5 illustrates an exemplary system 150 for making a building panel of a desired cross-sectional shape from sheet material (e.g., galvanized steel sheet metal) and for curving such a panel longitudinally along its length. The system 150 shown in FIG. 5 comprises, among other things, a support structure 151 (e.g., a movable platform such as a towable trailer), a panel forming apparatus 160, a panel crimping apparatus 170, a power source 158 (e.g., a diesel engine, or a generator with one or more electric motors), a drive system including, e.g., a hydraulic system 168, for driving the panel forming apparatus 160 and the panel crimping apparatus 170 and for moving the panel through the panel forming apparatus 160 and the panel crimping apparatus 170, a coil holder 154 for holding a coil of sheet material 156, such as galvanized steel sheet, and a control system 162, such a microprocessor based controller (e.g., computer such as a personal computer containing a processing system and a memory) that can control the system operation including receiving and processing signals from various sensors such as distance sensors, position sensors, an engine speed sensor or other load sensor (e.g., to measure load being placed on the power system), and a panel speed sensor for detecting a linear speed of the building panel as it is formed and/or curved.

The panel forming apparatus 160 can be configured, for example, to comprise successive panel forming assemblies, each of which has a series of rollers to gradually impart a desired cross sectional shape to the panel, such as conventionally known to those of ordinary skill in the art. Any suitable configuration of panel forming assemblies could be used in this regard, the selection of which is within the purview of one of ordinary skill in the art based on the cross sectional shape of the building panel that is desired.

Figure 6:
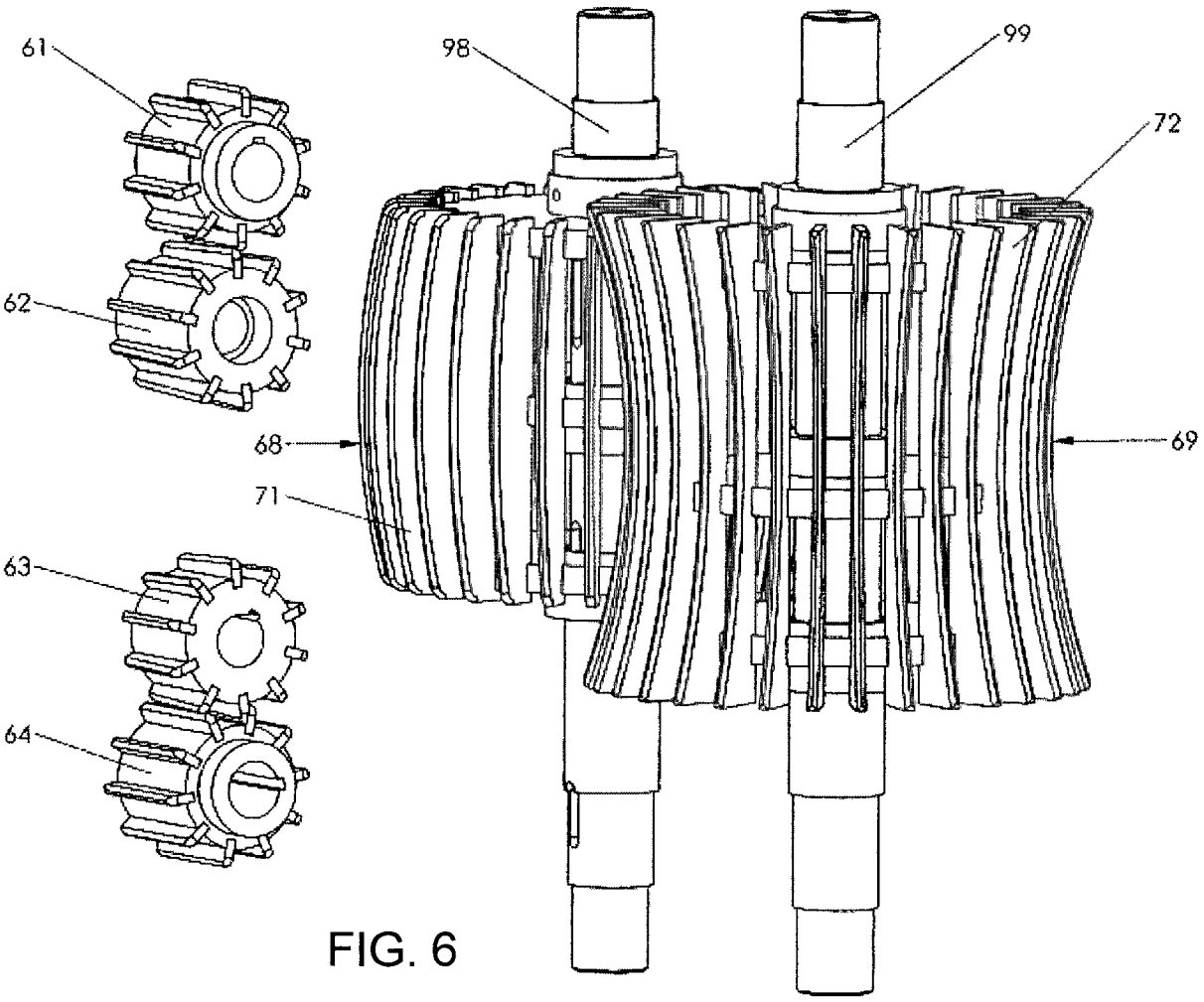
FIG. 6 illustrates crimping (corrugating) rollers having crimping blades of an exemplary panel crimping apparatus for imparting transverse corrugations into a building panel to provide a longitudinal curve thereto.

The panel crimping apparatus 170 of the example of FIG. 5 utilizes crimping (corrugating) rollers with crimping blades to impart transverse corrugations of suitable depth into the panel to provide the longitudinal curve (arch) to the building panel, such as previously disclosed herein. FIG. 6 shows a schematic illustration of an exemplary general configuration of a pair of center (main) crimping rollers 68 and 69, a pair of side crimping rollers 61 and 62, and another pair of side crimping rollers 63 and 64, that may be utilized in panel crimping apparatus 170. The pair of side crimping (corrugating) rollers 61 and 62 is provided for crimping one side portion of a building panel, and the pair of side crimping (corrugating) rollers 63 and 64 is provided for crimping the other side portion of the panel, each respective roller being supported by respective shafts and suitable support/frame members (not shown). Each of the side crimping rollers comprises multiple crimping blades for crimping a side portion of a building panel.

The pair of main crimping (corrugating) rollers 68 and 69 is provided for corrugating the center portion of the panel. The roller 68 is supported by shaft 98, and the roller 69 is supported by another shaft 99. The roller 68 has a plurality of radially extending circumferentially spaced blades 71, each having a convex profile in this example, and roller 69 has a plurality of radially extending circumferentially spaced blades 72, each having a complementary concave profile in this example. Of course, any suitable shapes for the blades could be used depending upon the desired cross sectional shape of the panel being curved. During operation as the rollers 68 and 69 rotate, a convex blade on roller 68 will protrude between two adjacent concave blades on the roller 69 to form the corrugations as the center of the panel passes therethrough. Similarly, the respective blades for side rollers 61 and 62 and rollers 63 and 64 form suitable corrugations in the side portions of the building panel. By imparting the various corrugations into the panel, the crimping apparatus 170 provides a longitudinal curve to the panel.

In the example of FIG. 5, the panel forming apparatus 160 and the coil holder 154 are oriented horizontally, but the panel forming apparatus 160 and coil holder 154 could be oriented vertically, if desired. The coil holder 154 and the panel forming apparatus 160 are located proximate to one another on a common support structure 151 (e.g., mobile trailer platform) in this example, and sheet material from the coil 156 can be fed directly into the panel forming apparatus 160. The panel crimping apparatus 170 is located adjacent to the panel forming apparatus 160 in this example, such that a "two step" process is used to form and then curve the building panel, wherein a longitudinally straight building panel can be generated and removed from the panel forming apparatus 160 in a first step, and then, in a second step, the straight building panel can be repositioned fed into a vertically oriented panel crimping apparatus 170 (i.e., such that the shafts 98 and 99 of the crimping rollers 68 and 69 of crimping apparatus 170 are oriented substantially vertically). A shearing apparatus 164 can be placed at the exit of the panel forming apparatus 160.

However, the coil holder 154, the forming apparatus 160 and the crimping apparatus 170 could all be oriented vertically on the support structure 151. Moreover, with such a vertical orientation, the coil holder 154, the forming apparatus 160 and the curing apparatus 170 can be positioned along a line, wherein these components can be arranged so that sheet material is directly fed from the coil holder 154 into the forming apparatus 160 and such that the shaped panel generated in the forming apparatus 160 with the desired cross sectional shape can be directly fed into the crimping apparatus 170 in a "single step," i.e., without having to remove and reposition the panel so as to feed it into the crimping apparatus 170.

Panel forming apparatus 160 and panel crimping apparatus 170 can be used to make panels from sheet material, such as, for example, structural galvanized steel sheet metal ranging from about 0.035 inches to about 0.080 inches in thickness. An exemplary advantageous thickness for 12-inch wide panels made from galvanized steel sheet is in the range of about 0.040-0.048 inches, and an exemplary advantageous thickness for 24-inch wide panels made from galvanized steel sheet is in the range of about 0.060-0.068 inches. Advantageous panel widths (e.g., measured from one side of the formed panel to the other side of the panel) include 12 inches and 24 inches, but other panel widths can also be used, the selection of which is within the purview of one of ordinary skill in the art. Such building panels can be formed from other sheet materials as well, such as other types of steel, galvalume, zincalume, aluminum, or other sheet building material that is suitable for construction. The thickness of such building panels may generally range from about 0.035 inches to about 0.080 inches in thickness (±10%), depending on the type of sheet material used. Of course, building panels may be formed using other thicknesses and using other sheet building materials so long as the sheet materials possess suitable engineering properties of strength, toughness, workability, etc., for the project at hand.

Figure 7:
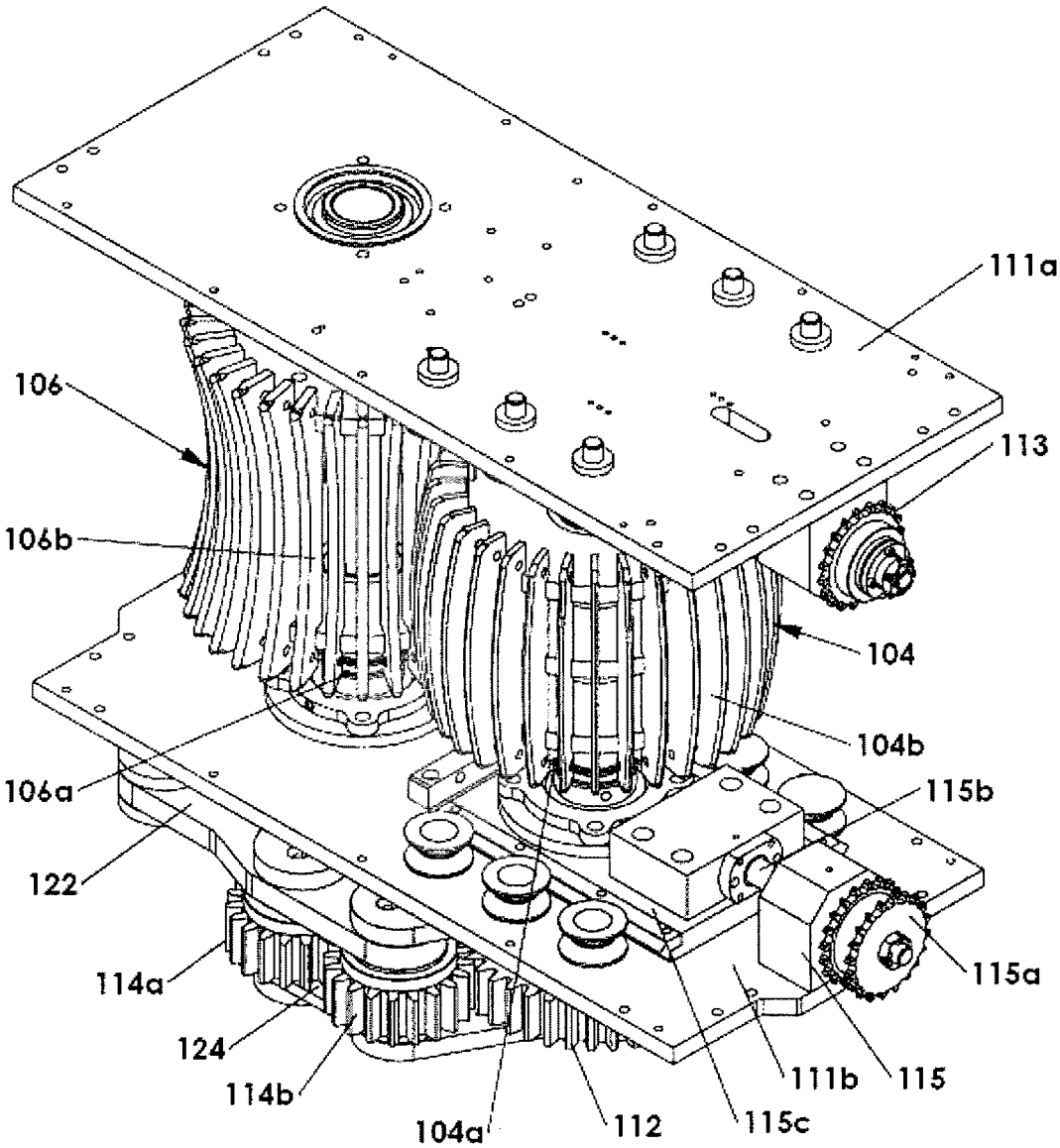
FIG. 7 illustrates an exemplary panel crimping apparatus including exemplary crimping rollers and an exemplary drive system.

The panel crimping apparatus 170 includes an advantageous timing control system for controlling the timing between a pair of crimping rollers that is not found in conventional panel crimping machines, such as those disclosed in U.S. Pat. Nos. 3,902,288, 4,364,253, 4,505,143, 5,249,445, 6,820,452 and 6,722,087, and 8,033,070. FIG. 7 illustrates an exemplary main crimping portion of the exemplary panel crimping apparatus 170 for curving a building panel which uses such improved timing control. FIG. 7 shows a first crimping roller 104 driven by a shaft 104*a* with a set of first crimping blades 104*b*, and an second crimping roller 106 driven by another shaft 106*a* with a set of second crimping blades 106*b*. The rollers 104 and 106 are supported by frame members 111*a* and 111*b*. A drive mechanism 113 comprising a drive sprocket, a threaded rod and mating threaded nut (e.g., a ball screw and a ball nut, or an Acme screw and mating Acme nut with trapezoidal flat top threads) positions the shaft 104*a* of the first crimping roller 104. A drive mechanism 115 comprising a drive sprocket 115*a* connected to a threaded shaft 115*b* that mates to a threaded nut (e.g., a ball screw and a ball nut, or an Acme screw and mating Acme nut with trapezoidal flat top threads) and other suitable bearings controls the position of a movable frame member 115*c* so as to control the center distance, or separation distance, between the shafts 104*a* and 106*a* of rollers 104 and 106. As shown in FIG. 7, link 122 may be formed of a single piece of metal that connects the shafts corresponding to idler gears 114*a* and 114*b* as well as well as being connected via a rotatable connection to link 120. Moreover, link 124 shown in FIGS. 7, 8A and 8B could also be formed to have the connections as link 122.

Figure 8A:
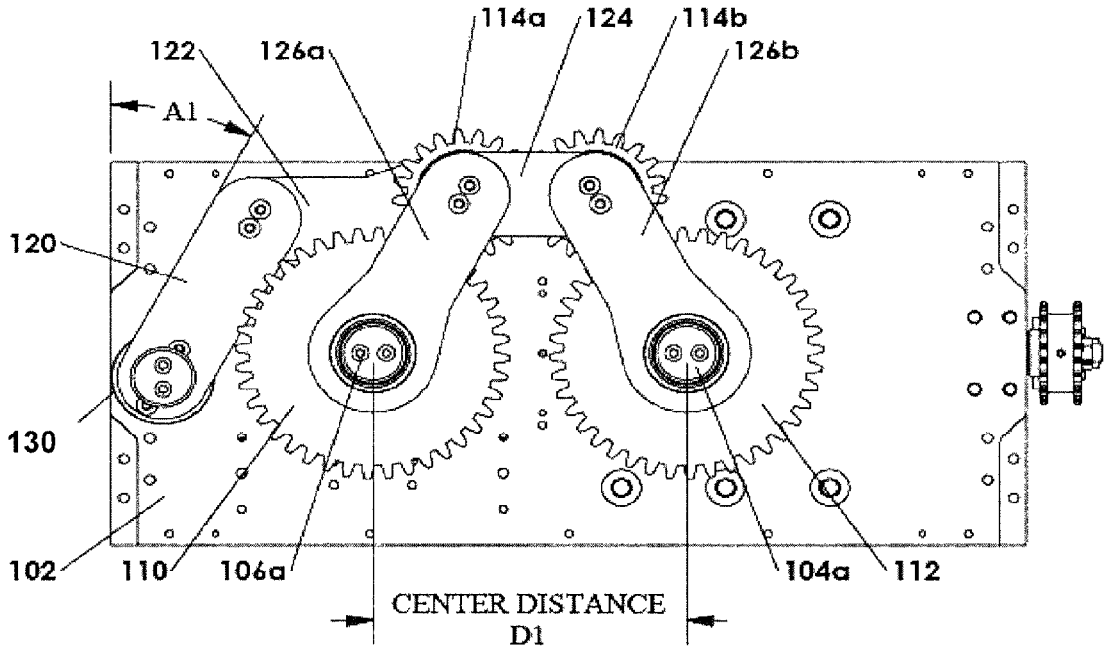
FIG. 8A illustrates a view of a portion of an exemplary drive system for controlling timing of crimping rollers of the exemplary panel crimping apparatus with a center distance (separation distance) between shafts of adjacent panel crimping rollers.

FIG. 8A shows the bottom view of the main crimping assembly of FIG. 7 wherein the laterally movable crimping roller 104 is positioned for a center (separation) distance D1 between the crimping rollers 104 and 106. As shown in FIG. 8A, the improved timing control system of the panel crimping apparatus 170 includes a control linkage comprising a fixed crimper roller drive gear 110, two idler gears 114*a* and 114*b*, a moveable crimping roller drive gear 112, a main gear link 126*a*, a main gear link 126*b*, a first control link 120, a second control link 122, and an idler link 124. The idler gears 114*a* and 114*b* are mounted on shafts (hidden) whose positions are governed by the overall control linkage. The main gear link 126*a* connects the shaft of the fixed crimping roller 106 to the first idler gear 114*a* shaft keeping gears 110 and 114*a* at the correct center distance for minimum backlash and longest life. Similarly, the main gear link 126*b* connects the shaft of the moveable crimping roller 104 to the second idler gear 114*b* shaft keeping gears 112 and 114*b* at the correct center distance. Idler link 124 connects the idler gear shafts at the correct center distance for the two idler gears 114*a* and 114*b*. A drive (rotational force) to rotate the crimping rollers 106 and 104 can be supplied by a gear meshed with gear 110 (of the fixed crimping roller 106). Alternatively a sprocket could be added to shaft 106*a* so the crimping assembly could be driven by a chain. The power to drive the crimping rollers 104 and 106 can be provided by power source 158 via any suitable driving system comprising any suitable combination of hydraulics, drive shafts, gears, chains and/or sprockets under the control of control system 162.

The first control link 120 is attached to a stationary pivot 130 at one end and to a second control link 122 via a rotational joint at the other end. The second control link 122 is also connected to the shafts of both idler gears 114*a* and 114*b* (and thereby connected to main control links 126*a* and 126*b*) directly and, in this example, through idler link 124. The combination of the first control link 120, second control link 122, main gear link 126*a* and the base plate 102 comprises a four bar linkage with equal pairs of opposing sides. Opposing links of the four bar linkage with equal opposing sides will remain parallel through the range of motion of the linkage; therefore, this linkage will maintain first control link 122 and idler link 124 parallel to the direction of travel of the moveable crimping roller. By maintaining the first control link 122 and idler link 124 parallel, proper timing is maintained throughout the range of motion of the moveable crimping roller such that proper timing is maintained between the first and second crimping rollers 104 and 106 even as the separation distance between those rollers is adjusted, e.g., for purposes of adjusting the depths of corrugations imparted to the building panel being curved by crimping.

Figure 8B:
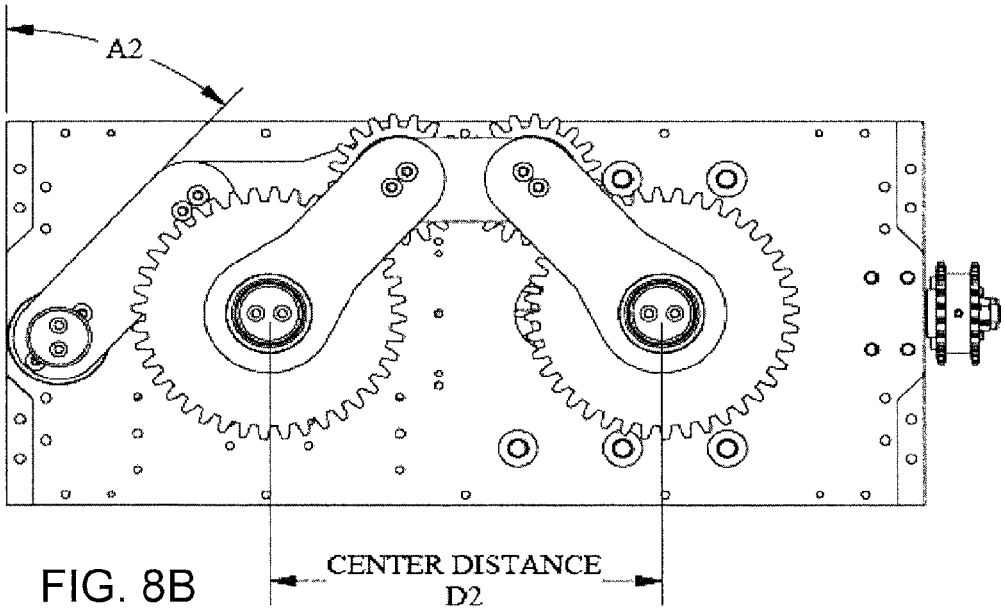
FIG. 8B illustrates a view of a portion of an exemplary drive system for controlling timing of crimping rollers of the exemplary panel crimping apparatus with a different center distance (separation distance) between the shafts of the adjacent panel crimping rollers.

FIG. 8B shows the moveable crimping roller 104 positioned for a greater center (separation) distance D2 between the shafts for the first and second crimping rollers 104 and 106 as compared to FIG. 8A. Links 122 and 124 move parallel relationship to the direction of lateral movement of crimping roller 104, and the angle A2 is increased compared to angle A1 of FIG. 8A while timing and rotational drive are maintained between the crimping rollers 104 and 106. At any position within the travel of the moveable crimping roller 104, the potential timing error never exceeds the small amount of backlash typically present in drive trains made up of toothed gears. Thus, the inventive control linkage is able to maintain proper timing during the rotation of the crimping rollers even while the separation distance between the crimping rollers is adjusted in real time to change depth of the corrugations in the panel during rotation of the crimping rollers.

In the inventive system disclosed herein the idler gears 114*a* and 114*b* may each have the same tooth count. In addition, in the inventive system disclosed herein the drive gears 110 and 112 may each have the same tooth count. Moreover, as shown in FIGS. 8A and 8B, the link 124 is oriented parallel to an imaginary line connecting the centers of drive gears 110 and 112 (the same line connecting the centers of shafts 104*a* and 106*a*). Moreover, as explained above, the positions of both idler gears 114*a* and 114*b* can be repositioned during operation as the center (separation) distance between the crimping rollers 104 and 106 is adjusted. The various components of the panel crimping apparatus including the timing control linkage described herein can be made from any suitable machine steel as understood by those of ordinary skill in the art. In addition, although the examples of FIGS. 7, 8A and 8B illustrate a pair of crimping rollers 104 and 106 where crimping roller 104 is laterally movable and crimping roller 106 is fixed, in an alternative embodiment, both crimping rollers 104 and 106 may be laterally movable so at move equidistance from a common center position. In such an embodiment, control link 120 would be unnecessary and control link 124 could be maintained in an orientation parallel to the direction of movement of the two crimping roll shafts 104*a* and 106*a* by an arrangement of linear bearings. Moreover, the exemplary overall control linkage system illustrated in FIGS. 7, 8A, and 8B may be applied to the pair of side crimping rollers 61 and 62 and the pair of side crimping rollers 63 and 64 shown in FIG. 6 as well.

In operation, sheet material can be fed from coil holder 154 to the forming apparatus 160 to generate a panel with a non-planar cross sectional shape. That panel with the non-planar cross sectional shape can then be fed into the crimping apparatus 170 to impart transverse corrugations into the panel to curve the panel in the longitudinal direction under the control of the control system 162. For instance, the control system 162 can control, using suitable hydraulics and servo motors for instance, the depths of corrugations in one section of a panel to provide one radius of curvature and the depths of corrugations in another section of the panel to provide a different radius of curvature, such that different sections of the panel may possess longitudinally straight sections and longitudinally curved sections having different radii of curvature.

The panel crimping apparatus with the above described control linkage can provide significant advantages for controlling the timing over conventional panel crimping machines. Conventional crimping machines known in the art have used two different methods for allowing adjustment of the center distance between crimping rollers while driving the crimping rollers and maintaining timing between the crimping blades. In one approach, such as described in U.S. Pat. No. 4,505,143, for example, a panel crimping machine uses two large gears in direct mesh to provide the timing and drive between the crimping rollers. Adjustment screws provide a basis to move threaded blocks which apply forces to supporting plates which then move one crimping roller relative to a fixed crimping roller, and which also thereby move the associated movable timing gear relative to the fixed timing gear. Such a direct drive system using toothed gears may have several disadvantages. First, the adjustment range of the center distance is limited to the height of the gear teeth. If this distance is exceeded the drive and timing will be lost. Second, as the center distance between the crimping rollers is increased, the precision of the timing is reduced, because the gear teeth are tapered, and as the center distance is increased, a narrower portion of each tooth is operating within a wider gap between teeth on the mating gear. Finally gear life is reduced when gears are meshed at a non-optimal center distance. The inventive system disclose herein can overcome such disadvantages.

In a second conventional approach for controlling timing between panel crimping rollers, a crimping machine may uses a combination of gears, chains, jackshafts and tensioners to maintain timing and provide drive, such as disclosed, for example, in U.S. Pat. No. 5,249,445. This is a somewhat more complex method which allows a greater range of adjustment than the first conventional method, but suffers from certain disadvantages. In this approach, a movable crimping roller is able to move linearly in a lateral direction relative to fixed crimping roller to adjust the separation distance between crimping rollers and thereby depth of crimp. As the movable crimping roller moves in a linear direction that is tangent to a sprocket, the center distance between that roller's shaft and the sprocket changes resulting variation in the tension of an associated drive chain. A chain tensioner must be used to control the chain tension variation. As the chain tensioner controls the slack in the chain, timing between the pair of crimping rollers is altered. In addition, the translational movement of the movable crimping roller relative to the fixed crimping roller causes a further change in timing between the crimping rollers because of the constraint imposed by the sprocket that provides the chain drive to the movable crimping roller.

Figure 9:
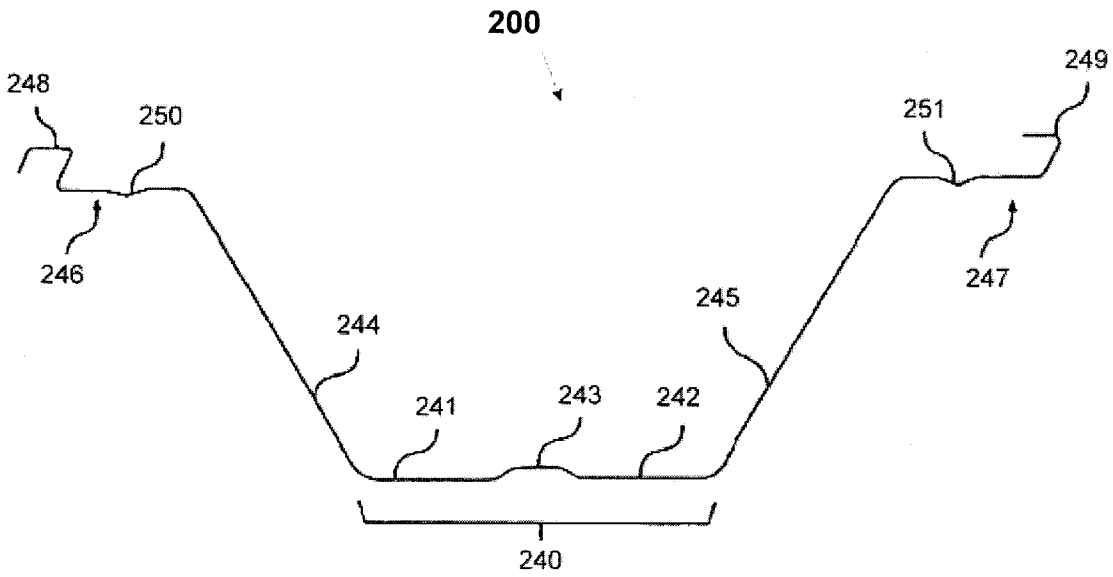
FIG. 9 illustrates a cross sectional shape of an exemplary building panel that can be curved according to one aspect.

The system 150 for making building panels disclosed herein, including the panel crimping apparatus 170, can be used to fabricate building panels of any suitable cross sectional shape. Some exemplary cross-sectional panel shapes applicable to the inventive system 150 disclosed herein are shown in FIGS. 9-12, whose panels would include transverse corrugations of the type illustrated in FIG. 4 herein. Of course, the system 150 described herein is not limited to the panel shapes illustrated in FIGS. 9-12. FIG. 9, for example, shows a cross-sectional view of an exemplary building panel. The exemplary building panel 200 includes a central portion 240, and two inclined sidewall portions 244 and 245 extending from opposite ends of the central portion 240. The central portion 240 is straight and in order to increase that portion's stiffness it may include one or more longitudinal ribs 243. Assuming the central portion includes a notched stiffener or longitudinal rib, the central portion 230 would be separated into two sub-central portions 241 and 242. The building panel 200 further includes two wing portions 246 and 247 extending from the inclined sidewall portion 244 and 245, respectively. The wing portions 246 and 247 are substantially parallel to the straight central portion 240 and may include notch stiffeners 250 and 251. A hook portion 248, extends from one wing portion 246, and a complementary hem portion 249 extends from the other wing portion 247, which provide a mechanism for connecting multiple panels together side-by-side. The center portion 240 and the side portions 244 and 245 may include transverse corrugations therein to facilitate curving the panel in the longitudinal direction.

Figure 10:
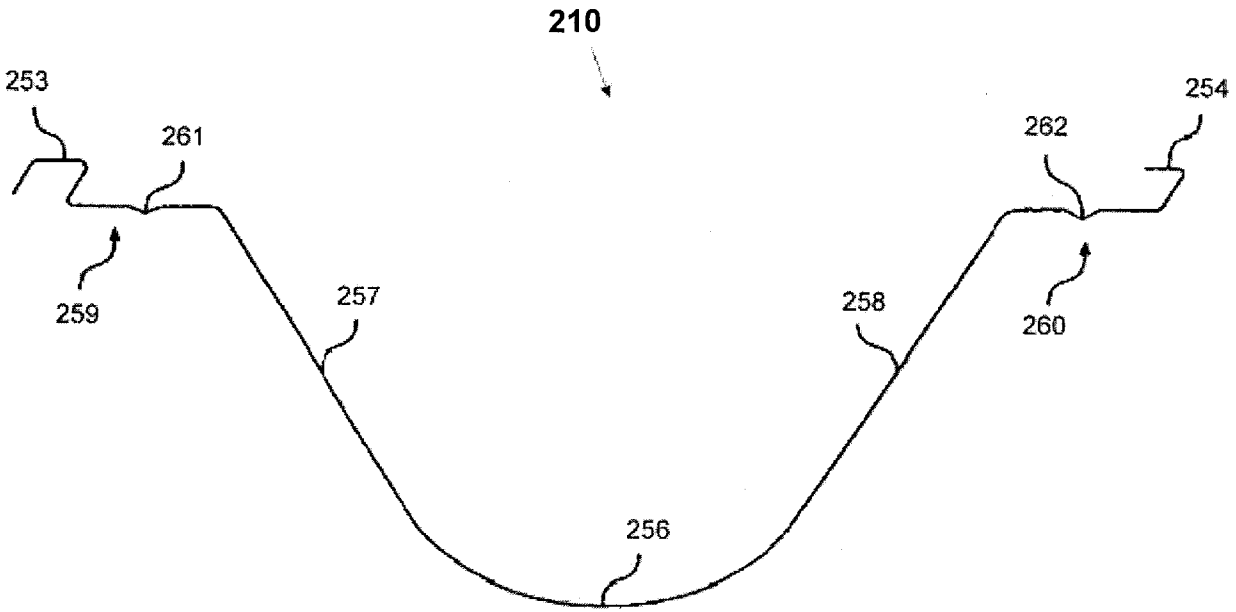
FIG. 10 illustrates a cross sectional shape of an exemplary building panel that can be curved according to another aspect.

FIG. 10 is a cross-sectional view of another exemplary building panel. The exemplary building panel 210 comprises a curved central portion 256 from the ends of which extend a pair of outwardly diverging inclined sidewall portions 257 and 258. The panel 210 also comprises two wing portions 259 and 260, which extend from the inclined sidewall portions 257 and 258, respectively. Stiffening notches 261 and 262 may be placed within the wing portions 269 and 260 to increase the stiffness of those portions. A hem portion 254 is positioned at the end of one wing portion 260, and a complementary hook portion 253 capable of receiving the hem portion 254 is positioned at the end of the other wing portion 259. The center portion 256 and the side portions 257 and 258 may include transverse corrugations therein to facilitate curving the panel in the longitudinal direction.

Figure 11:
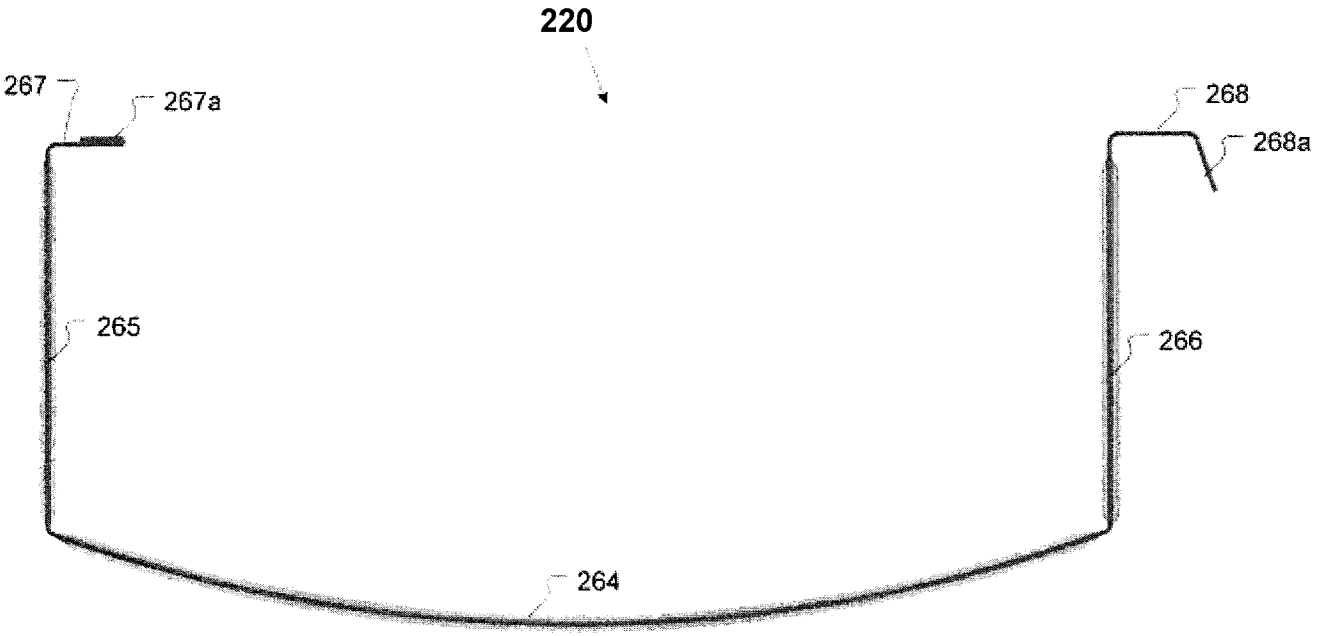
FIG. 11 illustrates a cross sectional shape of an exemplary building panel that can be curved according to another aspect.

FIG. 11 is a cross-sectional view of another exemplary building panel. The exemplary building panel 220 has, in cross section, a convex base 264, a pair of spaced upright side portions 265 and 266 projecting upwardly from the opposite edges of the base 264 in a direction transverse to the convex base 264, an upper flange portion 267 projecting inwardly from an upper edge of the side portion 265, and a complementary upper flange portion 268 that projects outwardly from an upper edge of the side portion 266. The flange portion 267 has a terminal section 267*a* bent toward the side portion 265 to provide a reverse bend or fold and a double thickness. The complementary flange portion 268 is bent downwardly to provide a straight, downturned terminal portion 268*a* providing an inverted, generally U-shaped connecting channel with a bottom opening configured to receive and connect to the flange portion 267 of an adjacent panel. The base 264 and the side portions 265 and 266 may include transverse corrugations therein to facilitate curving the panel in the longitudinal direction.

Figure 12:
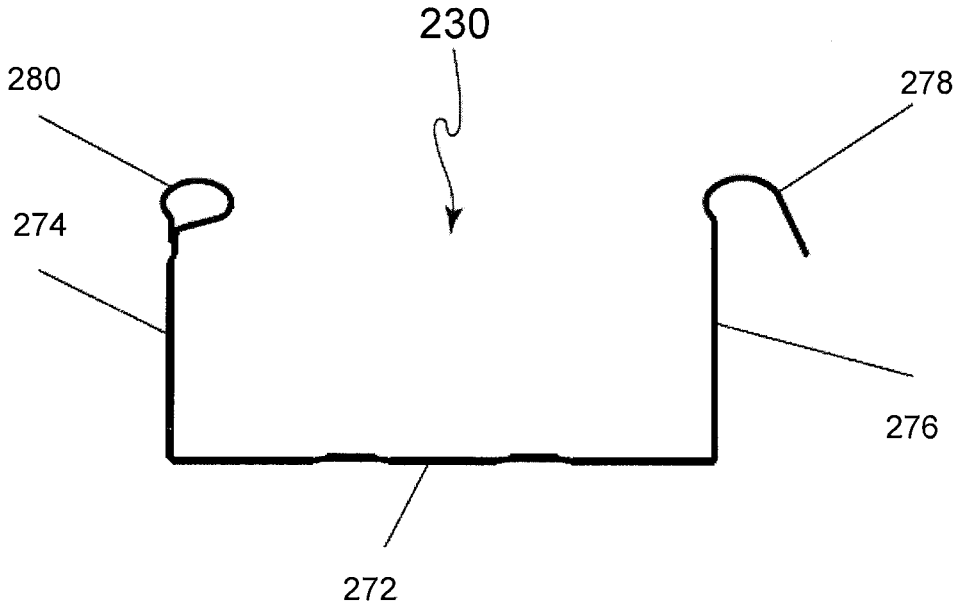
FIG. 12 illustrates a cross sectional shape of an exemplary building panel that can be curved according to another aspect.

FIG. 12 is a cross-sectional view of another exemplary building panel. The exemplary building panel 230 has, in cross section, a center portion 272, a pair of spaced upright side portions 274 and 276 projecting upwardly from the opposite edges of the center portion 272, a hook 278 at the end of one side portion, and a loop 280 at the end of the other side portion. The hooks 278 and loops 280 of adjacent building panels together, wherein the hook 278 of one panel is bent over the loop 280 of an adjacent panel, such as described in U.S. patent application Ser. No. 13/411,107 filed Mar. 2, 2012, the entire contents of which are incorporated herein by reference. The "hook" connecting portion refers to a cross-sectional shape having an arcuate portion attached to an open end portion. The "loop" connecting portion refers to a cross-sectional shape that is substantially oval, elliptical, or circular in cross section, and is tubular in shape along the length of the building panel.

In another exemplary aspect, the control system 162 may implement adaptive control of a drive system such as described in U.S. Patent Application Publication No. 20120323354, the entire contents of which are incorporated herein by reference. In an adaptive control system, the drive system can be controlled in response to a signal from a load sensor and an optional speed sensor so as to control the load on the power supply (e.g., a diesel engine) as the building panel moves along the panel forming apparatus 160 and/or panel curving apparatus 170. This feature can aid in determining whether the power supply is being put under too great a load during an operation of forming and curving the building panel and, if so, to reduce the speed at which the panel is being processed so as to reduce the load on the power supply to prevent stalling or other malfunction.

While the present invention has been described in terms of exemplary embodiments, it will be understood by those skilled in the art that various modifications can be made thereto without departing from the scope of the invention as set forth in the claims.

What is claimed is:

1. A panel crimping machine, comprising:

a frame;

a first crimping roller supported by the frame, the first crimping roller comprising a first shaft, a plurality of first crimping blades, and a first gear attached to the first shaft;

a second crimping roller supported by the frame, the second crimping roller comprising a second shaft, a plurality of second crimping blades, and a second gear attached to the second shaft, wherein a distance between the first and second shafts of the first and second crimping rollers is adjustable;

a third gear and a fourth gear, the third and fourth gears configured to mesh with each other, the third gear configured to mesh with the first gear, and the fourth gear configured to mesh with the second gear;

a first link rotatably connecting the first shaft and a shaft of the third gear;

a second link rotatably connecting the second shaft and a shaft of the fourth gear;

a third link rotatably connecting shafts of the third and fourth gears; and a control linkage configured to maintain timing between the first and second crimping rollers during driving of the first and second crimping rollers over an adjustable range of distance therebetween.

2. The panel crimping machine of claim 1, wherein the control linkage comprises:

a first control link and a second control link, the second control link rotatably connected to respective shafts of the third and fourth gears, the first control link rotatably connected to the second control link and rotatably connected to the frame, wherein the first and second control links are configured to control positions of the third and fourth gears in dependence upon the separation between the first and second crimping rollers so as to maintain proper timing between the first and second crimping rollers.

3. The panel crimping machine of claim 1, wherein the third gear and the fourth gear have a same tooth count.

4. The panel crimping machine of claim 1, wherein the first gear and the second gear have a same tooth count.

5. The panel crimping machine of claim 1, wherein the third link is oriented parallel to an imaginary line connecting the centers of the first gear and the second gear.

6. The panel crimping machine of claim 1, wherein center positions of both the third gear and the fourth gear are configured to be changed during operation as the distance between the first and second shafts of the first and second crimping rollers is adjusted during operation.

7. The panel crimping machine of claim 1, comprising:

a pair of first side crimping rollers, each of said pair of first side crimping rollers comprising multiple crimping blades; and a pair of second side crimping rollers, each of said pair of second side crimping rollers comprising multiple crimping blades.

* * * * *